US011121473B2

(12) United States Patent
Chapman et al.

(10) Patent No.: US 11,121,473 B2
(45) Date of Patent: Sep. 14, 2021

(54) COMPACT CAVITY-BACKED DISCONE ARRAY

(71) Applicant: Massachusetts Institute of Technology, Cambridge, MA (US)

(72) Inventors: Adam J. Chapman, Medford, MA (US); Alan J. Fenn, Wayland, MA (US); Pierre Dufilie, Marlborough, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 16/850,372

(22) Filed: Apr. 16, 2020

(65) Prior Publication Data

US 2021/0218153 A1 Jul. 15, 2021

Related U.S. Application Data

(60) Provisional application No. 62/960,265, filed on Jan. 13, 2020.

(51) Int. Cl.
*H01Q 21/00* (2006.01)
*H01Q 1/28* (2006.01)
(Continued)

(52) U.S. Cl.
CPC ..... *H01Q 21/0056* (2013.01); *H01Q 1/286* (2013.01); *H01Q 1/421* (2013.01); *H01Q 9/28* (2013.01); *H01Q 13/18* (2013.01)

(58) Field of Classification Search
CPC .... H01Q 21/0056; H01Q 1/286; H01Q 1/421; H01Q 13/18; H01Q 1/36; H01Q 9/28;
(Continued)

(56) References Cited

U.S. PATENT DOCUMENTS 3,787,865 A * 1/1974 MacDowell ..... H01Q 13/04 343/703
4,749,997 A * 6/1988 Canonico ..... H01Q 1/287 343/705

(Continued)

FOREIGN PATENT DOCUMENTS

JP 2005-94745 A 4/2005
JP 2013-175808 A 9/2013
RU 2599078 C1 10/2016

OTHER PUBLICATIONS

Balanis, "Antenna Theory Analysis and Design", Third Edition, Wiley Interscience, 2005.

(Continued)

*Primary Examiner* — Vibol Tan
(74) *Attorney, Agent, or Firm* — Nields, Lemack & Frame, LLC

(57) ABSTRACT

A compact shallow cavity-backed discone antenna array for conformal omnidirectional antenna applications is disclosed. The antenna array comprises a plurality of discone antennas arranged in a ring array within a circular contoured conical cavity. The cavity is covered with an electrically transparent radome. The individual discone antenna elements are fed with coaxial transmission lines. Good performance is demonstrated by simulation and by experiment in terms of reflection coefficient and omnidirectional gain radiation patterns from about 960 MHz to 1220 MHz. In one embodiment, the shallow cavity-backed discone antenna array may be used as a flush-mounted antenna that conforms to the outer mold line of an aircraft.

24 Claims, 6 Drawing Sheets

(51) Int. Cl.
*H01Q 1/42* (2006.01)
*H01Q 13/18* (2006.01)
*H01Q 9/28* (2006.01)

(58) Field of Classification Search
CPC ..... H01Q 13/02; H01Q 1/42; H01Q 21/065; H01Q 9/30; H01Q 13/04; H01Q 19/12; H01Q 1/28
See application file for complete search history.

(56) References Cited

U.S. PATENT DOCUMENTS 4,851,859 A 7/1989 Rappaport
6,697,031 B2 * 2/2004 Jocher ..... H01Q 9/28 343/790
7,446,725 B2 * 11/2008 Song ..... H01Q 9/28 343/789
8,749,451 B1 * 6/2014 Zamarron ..... H01Q 1/36 343/895
9,608,323 B1 3/2017 Berens et al.
2005/0122274 A1 * 6/2005 Marsan ..... H01Q 1/28 343/773
2005/0195117 A1 * 9/2005 Chadwick ..... H01Q 1/526 343/713
2019/0260107 A1 8/2019 Baur et al.

OTHER PUBLICATIONS

Chen et al., "A Wideband VHF/UHF Discone-Based Antenna", IEEE Antennas and Wireless Propagation Letters, vol. 10, pp. 450-453, 2011.
International Search Report and Written Opinion dated Aug. 3, 2020 in corresponding PCT application No. PCT/US20/28678.
O'Hagan et al., "A wideband antenna array for DVB-T based passive bistatic radar applications" Aug. 18, 2019, Retrieved from the Internet: <URL: https://www.researchgate.net/publication/260793965_A_ wideband_antenna_array _for_ DVB-T_based_ passive_bistatic_radar _applications>.

* cited by examiner

COMPACT CAVITY-BACKED DISCONE ARRAY

This application claims priority of U.S. Provisional Application Ser. No. 62/960,265 filed Jan. 13, 2020, the disclosure of which is incorporated herein by reference in its entirety.

This invention was made with Government support under Grant No. FA8702-15-D-0001 awarded by the U.S. Air Force. The Government has certain rights in the invention.

FIELD

This disclosure relates to discone antennas, and more particularly to an array of discone antennas disposed in a single cavity.

BACKGROUND

Antenna arrays for conformal omnidirectional vertically polarized coverage are desirable for transmit and receive communications and sensing applications in the ultra-high frequency (UHF) band and at lower and higher frequencies.

These antenna arrays may be created in a plurality of ways.

For example, discone antenna elements may be used to create the array. A discone antenna is a version of a biconical antenna, where one of the cones is replaced with a disc. These antennas are typically mounted such that the disc and bottom cone radiate and receive the electromagnetic waves.

In some embodiments, the discone antenna element may be disposed in an electrically conductive cavity. Single cavity-backed discone antenna elements are known to provide wideband omnidirectional vertically polarized performance.

However, an array of these single cavity-backed discone antennas may be rather large and unsuitable for certain applications, where space is limited.

Therefore, it would be beneficial if there were a system that provided the performance of an array of discone antennas, without requiring the space typically needed for such an array.

SUMMARY

A compact shallow cavity-backed discone antenna array for conformal omnidirectional antenna applications is disclosed. The antenna array comprises a plurality of discone antennas arranged in a ring array within a circular contoured conical cavity. The cavity is covered with an electrically transparent radome. The individual discone antenna elements are fed with coaxial transmission lines. Good performance is demonstrated by simulation and by experiment in terms of reflection coefficient and omnidirectional gain radiation patterns from about 960 MHz to 1220 MHz, which covers the Tactical Air Navigation (TACAN) frequency range. In one embodiment, the shallow cavity-backed discone antenna array may be used as a flush-mounted antenna that conforms to the outer mold line of an aircraft.

According to one embodiment, an antenna array is disclosed. The antenna array comprises a plurality of discone antenna elements, each discone antenna element comprising a disc and a cone separated by a spacer; a cavity having a bottom surface, wherein the plurality of discone antenna elements are all disposed in the cavity, such that the cone of each discone antenna element is in contact with the bottom surface. In certain embodiments, the plurality of discone antenna elements comprises 4 discone antenna elements. In some embodiments, the realized gain of the antenna array, when all of the discone antenna elements are fed, is within 2 dB over an entire range of azimuth for each frequency within a selected range of frequencies. In some embodiments, the selected range of frequencies is between 960 MHz and 1220 MHz. In certain embodiments, the realized gain of the antenna array, when all of the discone antenna elements are fed, is greater than −4 dBi (decibels relative to an isotropic antenna) over an entire range of azimuth over a selected range of frequencies. In certain embodiments, the antenna array comprises a radome, which may be curved. In certain embodiments, a maximum distance between the bottom surface and the radome is less than 75 mm.

According to another embodiment, an antenna array is disclosed. The antenna array comprises a plurality of discone antenna elements, each discone antenna element comprising a disc and a cone separated by a spacer; a cavity having a bottom surface, wherein the plurality of discone antenna elements are all disposed in the cavity; and a curved radome covering the cavity; wherein each discone antenna element has a central axis passing a center of the cone and the disc, and wherein the bottom surface is configured such that the central axis of each discone antenna element is perpendicular to the radome at the point of intersection. In certain embodiments, the plurality of discone antenna elements comprises 4 discone antenna elements. In some embodiments, the realized gain of the antenna array, when all of the discone antenna elements are fed, is within 2 dB over an entire range of azimuth for each frequency within a selected range of frequencies. In some embodiments, the selected range of frequencies is between 960 MHz and 1220 MHz. In certain embodiments, the realized gain of the antenna array, when all of the discone antenna elements are fed, is greater than −4 dBi over an entire range of azimuth over a selected range of frequencies.

According to another embodiment, an aircraft is disclosed. The aircraft comprises a fuselage, a wing and the antenna array described above. In certain embodiments, the antenna array is disposed on the wing, and the radome conforms to an outer mold line of the wing. In certain embodiments, the antenna array is disposed on the fuselage, and the radome conforms to an outer mold line of the fuselage.

BRIEF DESCRIPTION OF THE DRAWINGS

For a better understanding of the present disclosure, reference is made to the accompanying drawings, which are incorporated herein by reference and in which.

DETAILED DESCRIPTION

The present disclosure describes a cavity-backed discone antenna array. This array may be disposed in a large apparatus and may be made conformal with an outer surface of that apparatus. The apparatus may be a ground-moving vehicle, tower, ship, aircraft, satellite or other structure. Importantly, the present disclosure describes a cavity-based discone antenna array where multiple discone antenna elements are disposed in a single cavity.

Figure 1:
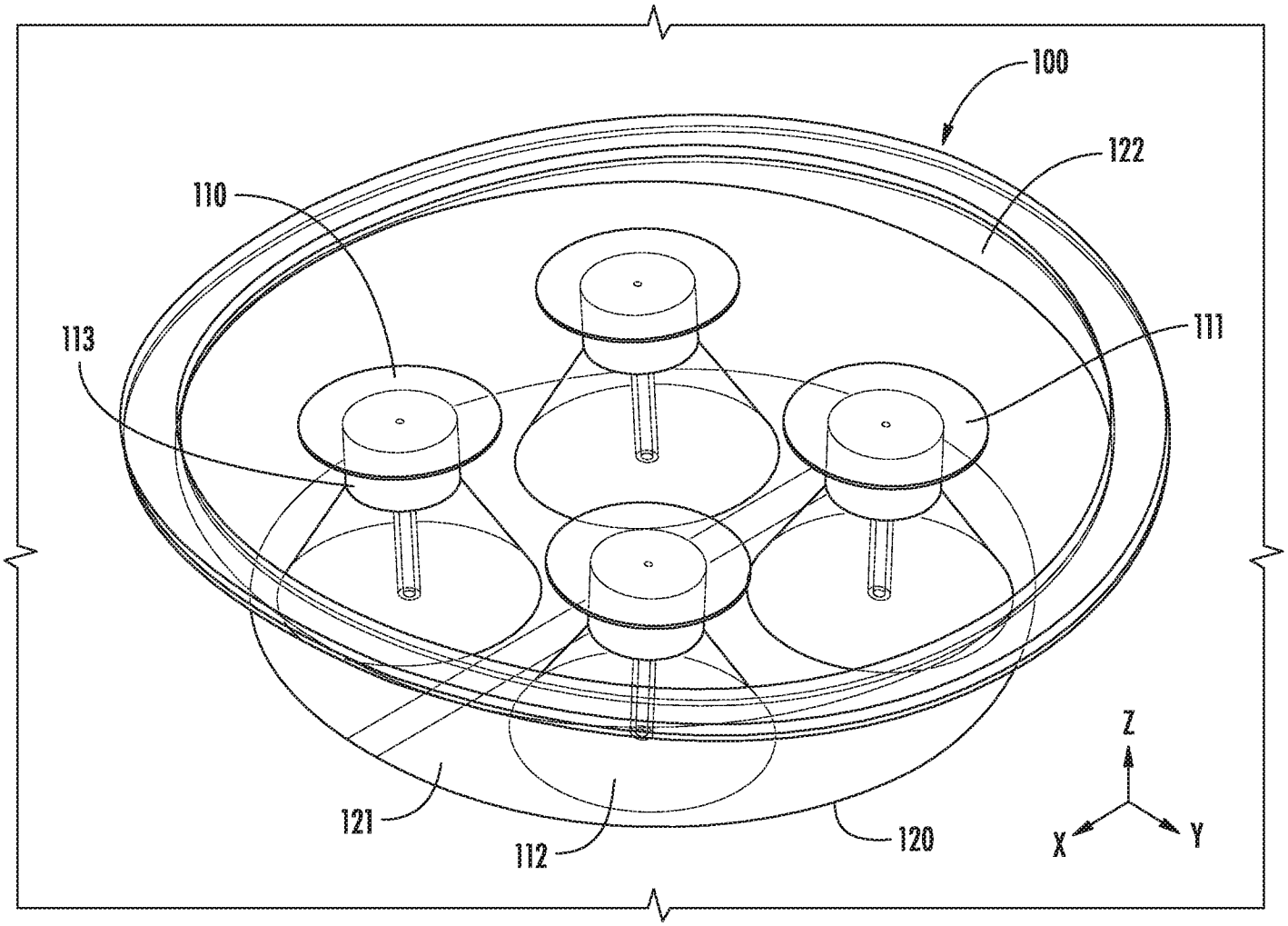
FIG. 1 shows an isometric view of the cavity-backed discone antenna array according to one embodiment.
Figure 2:
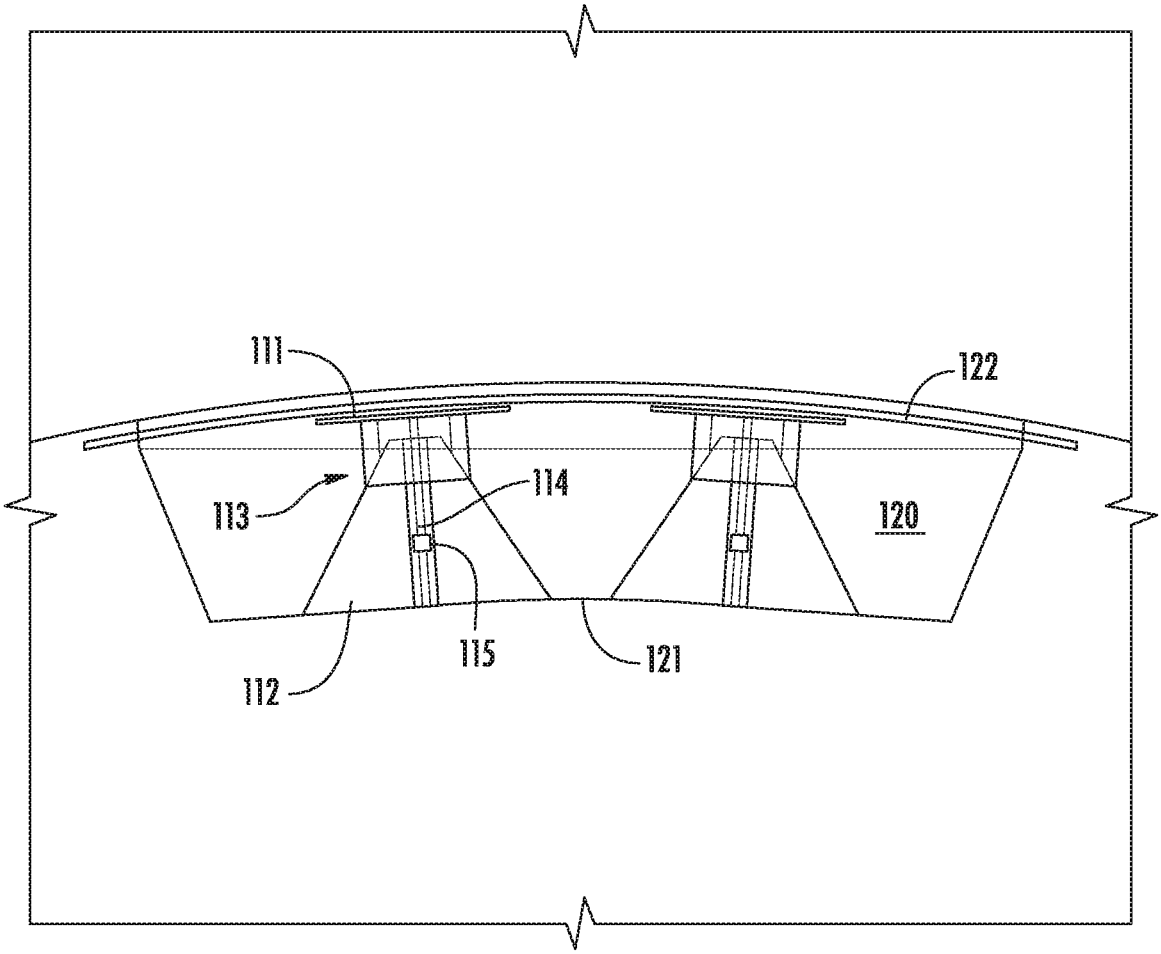
FIG. 2 shows a cross-sectional view of the antenna of FIG. 1.

FIG. 1 shows an isometric view of the cavity-backed discone antenna array 100 according to one embodiment. FIG. 2 shows a cross-sectional view of the cavity-backed discone antenna array 100 of FIG. 1.

The cavity-backed discone antenna array 100 includes a plurality of discone antenna elements 110. Each discone antenna element 110 comprises a disc 111, a cone 112, and an electrically non-conducting spacer 113 disposed between the disc 111 and the cone 112. The disc 111 and the cone 112 are constructed from a metal, such as copper or aluminum, although other metals may be used. The spacer 113 is made from an insulating material that is typically a dielectric material, but also may be a magnetic material.

The disc 111 may be a planar structure in the form of a short cylinder. The thickness of the disc 111 may be between 0.001 inches and 0.25 inches.

The cone 112 may be hollow and have a lower diameter that is greater than its upper diameter. In other words, the cone 112 tapers inward toward its top surface. The lower diameter of the cone 112 is therefore greater than the upper diameter of the cone 112. Further, the cone 112 has a height typically less than the cavity height to maintain a flush-mounted design.

The insulating spacer 113 physically and electrically separates the cone 112 and the disc 111. The spacer 113 may have a dielectric constant greater than 1. Further, the presence of the spacer 113 creates a disc/cone separation necessary to achieve the desired input impedance.

The dimensions selected for the diameter of the disc 111, the upper diameter and lower diameter of the cone 112, the dielectric constant and diameter of the spacer 113 and the disc/cone separation determine the operating frequency of the discone antenna element 110. For example, the diameter of the disc 111 determines the lowest operating frequency. In certain embodiments, the diameter of the disc 111 is roughly 0.7 times the quarter wavelength of the lowest desired frequency. The length of the tapered side of the cone 112 may be roughly the quarter wavelength of the lowest desired frequency.

As best seen in FIG. 2, a coaxial cable 114 is routed through the middle of the cone 112 to the disc 111. In the case of transmission, the coaxial cable provides the signal to the disc 111. In the case of reception, the coaxial cable carries the signal received by the disc 111. The central conductor of the coaxial cable 114 may be electrically connected to the disc 111, while the ground shield of the coaxial cable 114 is electrically connected to the cone 112. The coaxial cable 114 feeding the discone antenna element 110 will typically provide a 50-ohm characteristic impedance transmission line, but other higher and lower characteristic impedances may be used. In certain embodiments, the coaxial cable 114 may be terminated with a connector 115 that is recessed within the cone 112 to reduce the overall depth required by the cavity-based discone antenna array, which is a desirable feature in many applications where space is limited. In other embodiments, the connector may be disposed beneath the bottom surface 121.

The coaxial cables 114 may be in electrical communication with a receive circuit or a transmission circuit (not shown).

Each discone antenna element 110 has a central axis, which passes through the center of the disc 111 and the center of the cone 112. In FIG. 2, this central axis may be aligned with the coaxial cable 114.

All of these discone antenna elements 110 are disposed in a single cavity 120. In certain embodiments, all of the discone antenna elements 110 are the same.

The cavity 120 has a depth, a lower diameter and an upper diameter. The difference between the lower diameter and the upper diameter defines the flare angle of the cavity. Cavity flare provides a gradual transition from the cavity 120 and into free space. Increasing the upper diameter allows for a larger flare, allowing more power to be emitted from or received by the cavity 120. The upper diameter determines the overall aperture area. A larger lower diameter generally allows more power, providing better performance.

In certain embodiments, the top of the cavity 120 includes a radome 122. A radome 122 is a structural, weatherproof surface that protects the discone antenna array and is electromagnetically transparent. In certain embodiments, the radome 122 may be curved. For example, the discone antenna array may be disposed on an airplane, such as in the wing or fuselage. In this case, the radome may be a curved shape. The radome 122 may be curved in one direction or both directions.

The cavity 120 also has a bottom surface 121. The bottom surface 121 may serve as a ground plane. In certain embodiments, the bottom surface is planar. In other embodiments, such as that shown in FIG. 2, the bottom surface may be curved in one or both directions. In yet other embodiments, the bottom surface 121 may be the combination of two slightly inclined planar surfaces. In certain embodiments, the bottom surface is configured so that the central axis of each discone antenna element 110 is perpendicular to the radome 122 at their intersection point. The radome 122 may be a fiberglass epoxy, such as a flame retardant material, such as FR4. The thickness of the radome 122 may be 1.6 mm, although other thickness may be used.

In certain embodiments, the maximum distance between the bottom surface 121 and the radome 122 is less than 75 mm (i.e. 3 inches).

As noted above, the bottom surface 121 to which the discone antenna elements 110 conform acts as the ground plane of the cavity-backed discone antenna array 100. In some embodiments, the bottom surface 121 may be the fuselage of an aircraft.

In the data presented herein, the bottom surface 121 comprises a cylindrical section of length 914.4 mm and a radius of curvature of 618 mm. A sphere of the same radius of curvature is affixed to each end of the cylinder to form a capsule shape. The shape is then split to form a ground plane of height 152.5 mm and total length 1727.3 mm. Of course, other shapes may be used.

The performance of the cavity-backed discone antenna array 100 may be partially dependent on the size and shape of the bottom surface 121. In particular, the gain patterns may be dependent on the bottom surface 121 that is used.

The cones 112 may be in electrical contact with the bottom surface 121.

FIGS. 1 and 2 show a cavity 120 that has four discone antenna elements 110. These discone antenna elements 110 are disposed in a ring, separated from one another by 90°. However, more or fewer discone antenna elements may be disposed within the cavity 120. In the case of N discone antenna elements, the discone antenna elements may be arranged in a ring, separated from one another by 360°/N.

FIGS. 1 and 2 show a cavity 120 having a round bottom surface 121 and radome 122. However, other shapes can also be used.

Additionally, there is a relationship between the discone antenna elements 110 and the cavity 120. For example, if four discone antenna elements 110 are to be disposed in the cavity 120, the lower diameter needs to be sufficiently larger to accommodate the lower diameters of the four cones 112. Further, performance of the individual discone antenna elements 110 is improved by insuring a minimum inter-element spacing, and array performance is improved by insuring a maximum inter-element spacing of approximately one half-wavelength. This spacing allows beams and nulls to be formed by the array without introducing grating lobes or unintentional nulls in the radiation pattern of the array. The inter-element spacing determines the width of the radiated or received beams and the nulls that are formed with the array. If the bottom surface of the cavity 120 is not planar, the inter-element spacing also determines the direction each discone antenna element will focus its energy toward and the angle the central axis makes with the radome 122. The cavity may be fabricated by machining a block of aluminum or by plating the interior surface of a 3D printed plastic structure.

In certain embodiments, the cavity 120 is filled with a material having a low dielectric constant, such as Rohacell foam, which has a dielectric constant of 1.05. Other materials having a dielectric constant of less than 1.2 may also be used. This dielectric material provides structural support for the various parts of the antenna array and also provides a hermetic seal. These qualities are especially desirable in aircraft applications in which the antenna array will be subjected to high stresses. Filling the cavity 120 with foam prevents air gaps from causing pressure differentials between the interior and exterior of the cavity. The low dielectric constant of the foam prevents it from having a significant impact on the performance of the array. Using a higher dielectric constant material would introduce dielectric loading, which shifts the resonant frequency of the antennas to a lower frequency. This higher dielectric constant material may be used to design a smaller array at the same operating frequency.

In certain embodiments, the available space for the cavity-backed discone antenna array 100 may be limited. For example, in certain embodiments, the total height of the cavity 120 may be limited to 50-70 mm (i.e. 2-3 inches). Similarly, the diameter of the cavity 120 may be limited to 254 mm (10 inches) or less.

These constraints, especially regarding maximum cavity diameter and height, make the design of a high performance antenna array very challenging. For example, the maximum diameter of the cavity 120 may place constraints on inter-element spacing, which also affects the maximum bottom diameter of the cone 112.

As noted above, the size of each discone antenna determines its range of operating frequencies.

In one particular example, the range of operating frequencies is between 960 MHz to 1220 MHz. In this example, there are four discone antenna elements 110 disposed in the cavity 120. The lower diameter of the cavity 120 is 215.9 mm, which corresponds to 0.69λ at 960 MHz and 0.87λ at 1220 MHz. The cavity height may be 58.60 mm as measured from the lowest point to the highest point.

Each cone 112 has a lower diameter of 61.2 mm, an upper diameter of 12.50 mm and a height of 41.60 mm. These dimensions correspond to 0.20λ, 0.04λ, and 0.13λ at 960 MHz, respectively. Each disc 111 has a diameter of 47.3 mm, or 0.15λ at 960 MHz. A spacer 113 having a diameter of 25.4 mm is used to set a feed gap of 5.21 mm between the disc 111 and the top of the cone 112. These dimensions correspond to 0.08λ and 0.017λ at 960 MHz, respectively.

The measurements recited above may be scaled if the desired frequency range is different from that recited above. For example, if the desired frequency range is double the frequency range stated above, the dimensions could all be divided in half to achieve the same dimensions relative to the wavelength, and therefore achieve the same performance at the higher frequency range. The measurements recited above may also vary based on the application. For example, the number of antennas required and the amount of space available in a given application may result in a different set of optimal parameters. The measurements recited above may serve as a starting point for an optimization for a given design.

A cavity-backed discone antenna array 100 having the measurements recited above was then subjected to a plurality of simulations. In certain simulations, two different spherical coordinate angles are used, φ and θ. If the vertical direction is referred to as the Z axis, φ is defined as the rotation about the Z axis, also referred to as the azimuthal angle. The elevation angle, θ, is defined as the angle from vertical, where the elevation angle at vertical (zenith) is 0° and the elevation angle at horizontal (horizon) is 90°. That nomenclature is used to describe the graphs included herein.

The cavity-backed discone antenna array 100 used in these simulations comprises four discone antenna elements 110, which are located at azimuthal angles of 45°, 135°, −45° and −135°.

Figure 3:
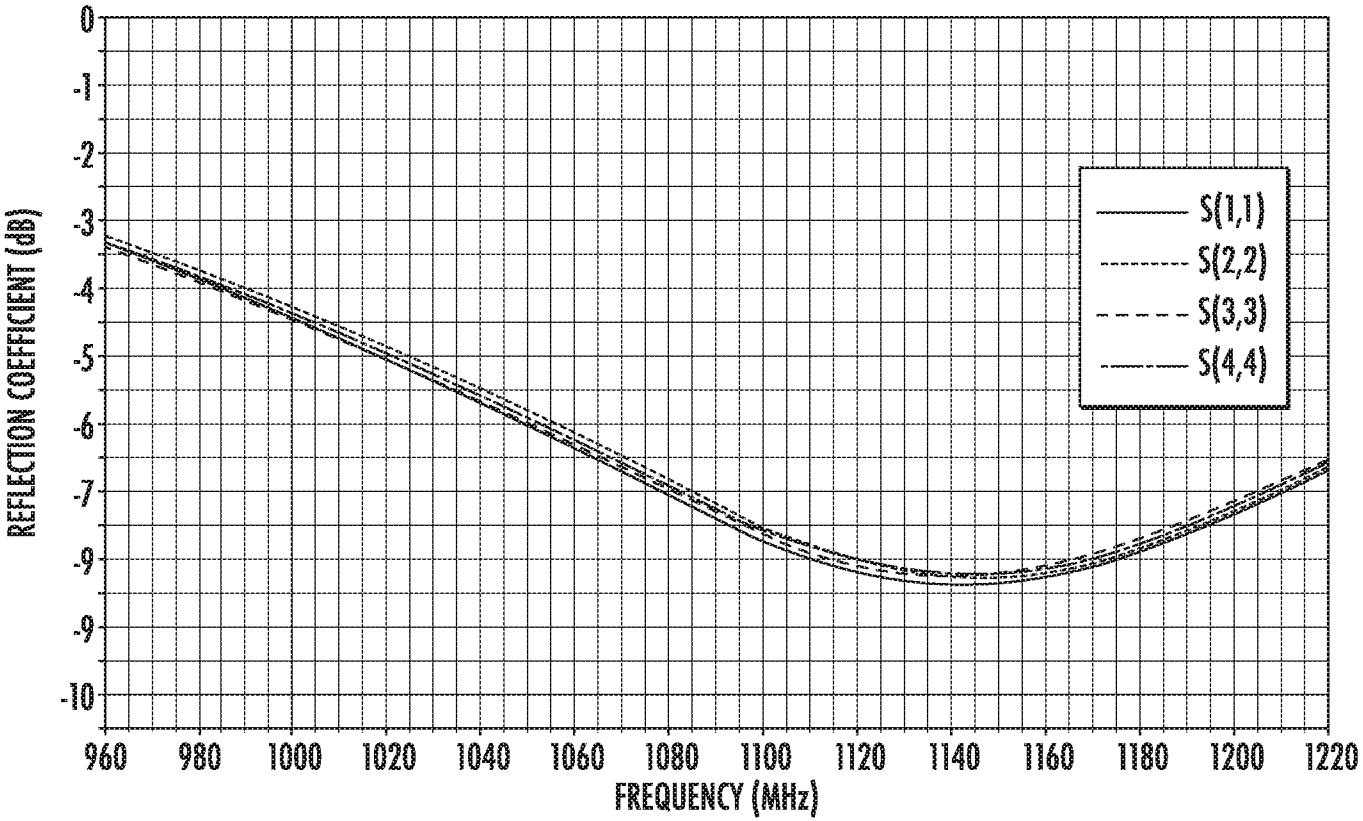
FIG. 3 shows a graph showing an electromagnetic simulation of the passive reflective coefficient of the cavity-backed discone antenna array.

FIG. 3 shows simulated passive reflection coefficients as a function of frequency for each of the four embedded discone antenna elements 110 in the cavity-backed discone antenna array 100. As can be seen, the reflection coefficient is roughly equal for all four discone antenna elements 110. Further, at all frequencies of interest, the reflection coefficient is −3 dB or less, indicating that, at all frequencies, less than 50% of the energy is reflected. The reflection coefficient could be improved through the use of an external matching circuit, which could be mounted on a printed circuit board below the antenna array. Improved matching would increase the realized gain of the antenna array.

Figure 4:
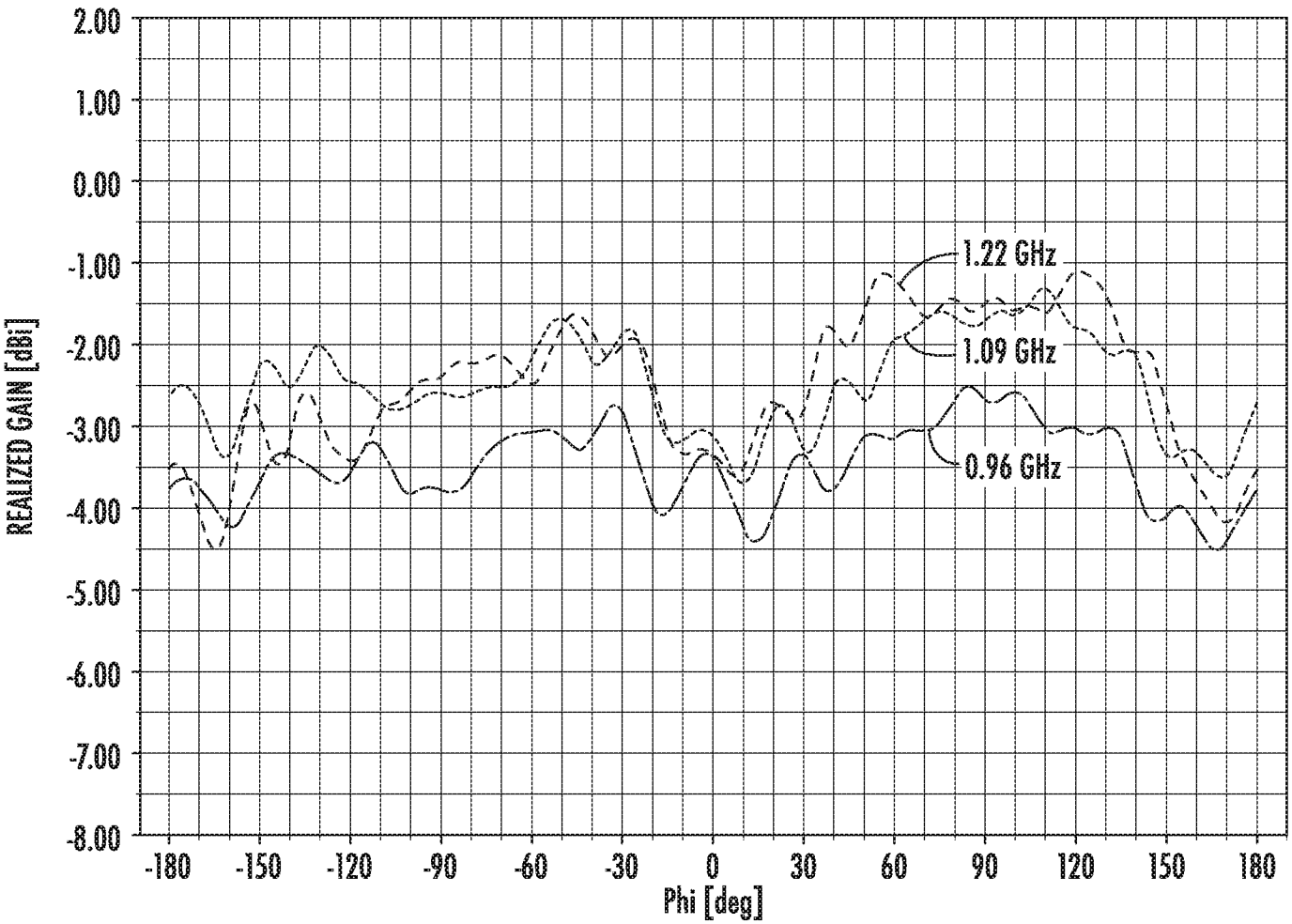
FIG. 4 shows a graph of simulated realized gain of the cavity-backed discone antenna array as a function of azimuth angle when one discone antenna element is fed.

FIG. 4 shows the realized gain patterns for the cavity-backed discone antenna array 100 where one of the discone antenna elements 110 is fed while the other three are terminated with matched loads (50-ohm resistive loads). The discone antenna element 110 located at an azimuth angle of 45° was fed in this simulation. Note that the cavity-backed discone antenna array 100 is omnidirectional. In fact, the difference in gain is less than 4 dB over the entire 360° range of azimuth angles for each frequency.

Figure 5:
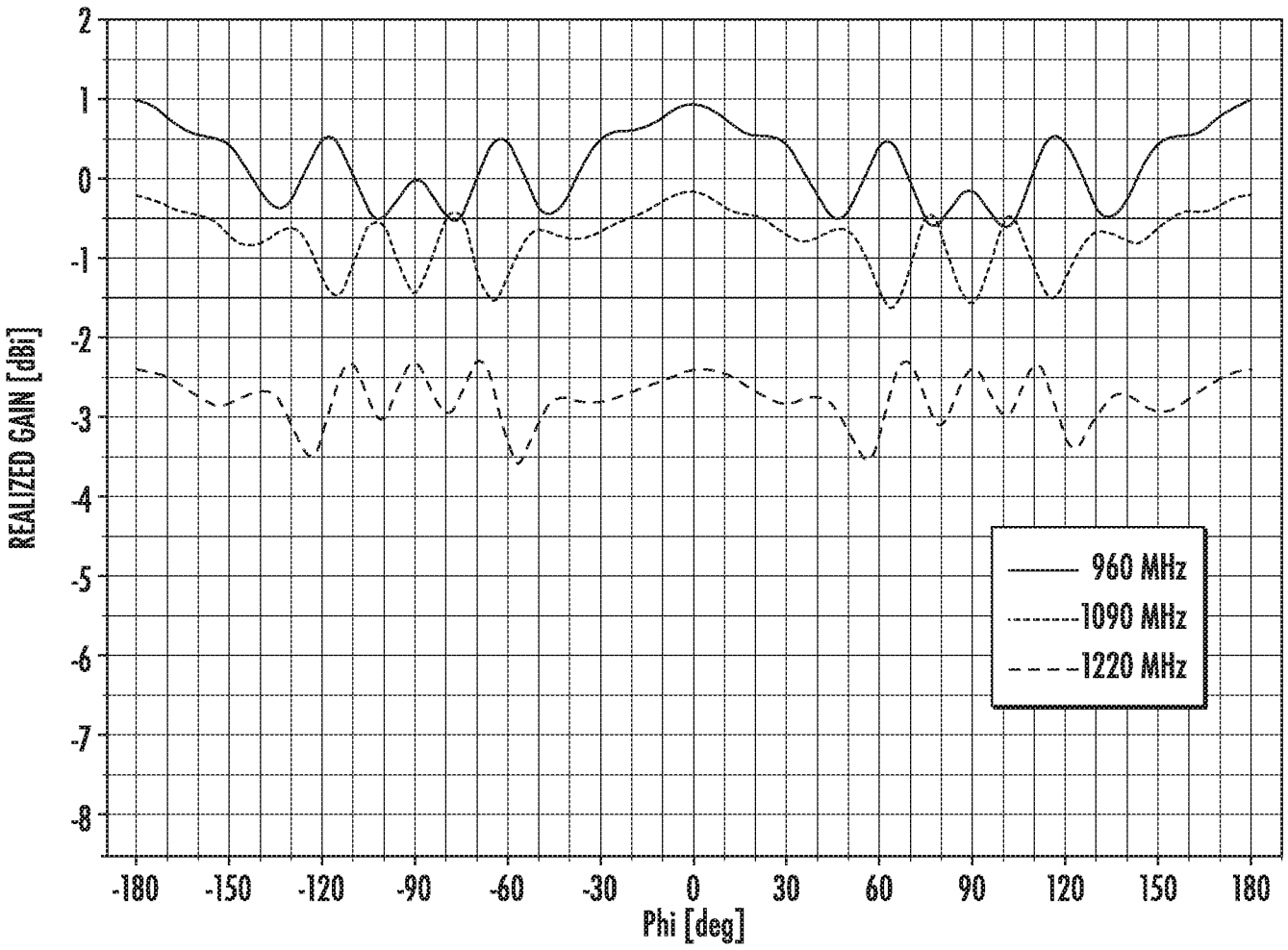
FIG. 5 shows a graph of realized gain of the cavity-backed discone antenna array as a function of azimuth angle when all of the discone antenna elements are fed with equal amplitude and equal phase.

FIG. 5 shows the realized gain patterns at θ=90° (the horizon) for the cavity-backed discone antenna array 100 where all of the discone antenna elements 110 are fed in phase. Note that the difference in gain for a particular frequency is less than 2 dB over the entire 360° range of azimuth angles. This shows that the cavity-backed discone antenna array 100 has excellent omnidirectional performance. Further, at all frequencies, over the entire 360° range of azimuth angles, the realized gain is greater than −4 dBi.

Figure 6A:
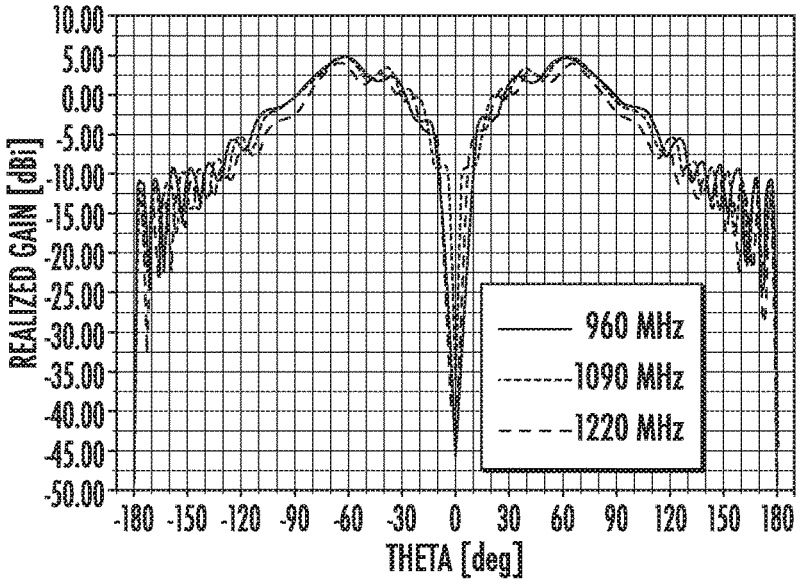
FIGS. 6A-6C shows graph of realized gain of the cavity-backed discone antenna array as a function of elevation angle for three different azimuth angles when all of the discone antenna elements are fed with equal amplitude and equal phase.
Figure 6B:
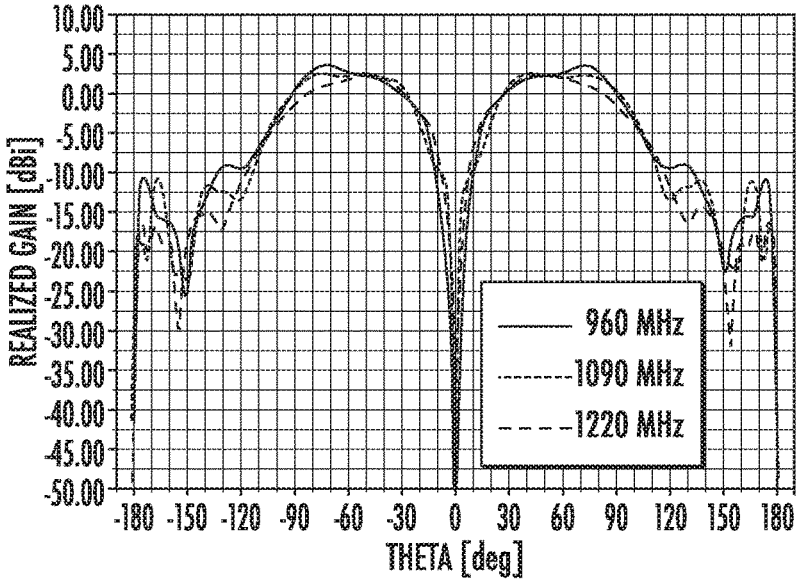
Figure 6C:
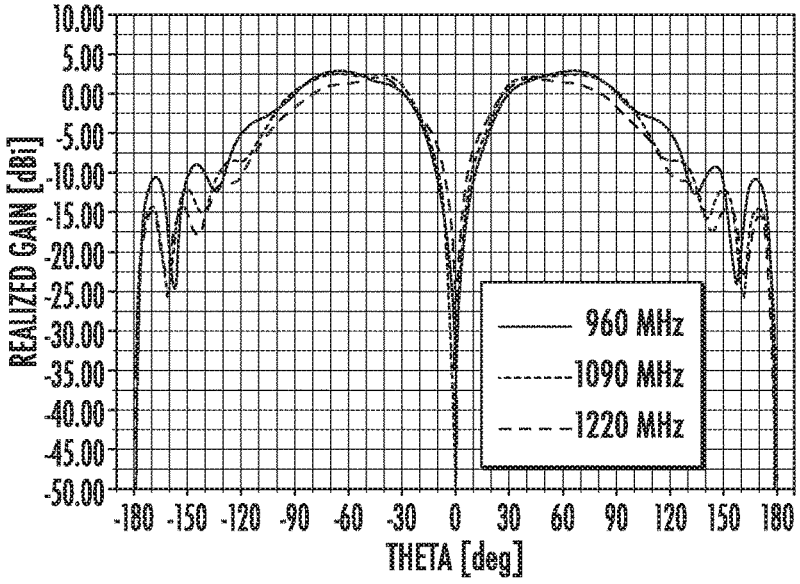

FIGS. 6A-6C shows the realized gain in the elevation direction for the cavity-backed discone antenna array 100 where all of the discone antenna elements 110 are fed in phase. In this test, the azimuth observation angle was fixed while the elevation angle was varied. In FIG. 6A, the azimuth angle was set to 0°, while in FIGS. 6B and 6C, the azimuth angle was 45° and 90°, respectively. These plots show that the main beam points above the horizon at approximately θ=70°. This is due to the finite ground plane that was used in the simulations.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. An antenna array, comprising:

a plurality of discone antenna elements, each discone antenna element comprising a disc and a cone separated by a spacer;

a cavity having a bottom surface, wherein the plurality of discone antenna elements are all disposed in the cavity, such that the cone of each discone antenna element is in contact with the bottom surface, wherein the realized gain of the antenna array, when all of the discone antenna elements are fed, is within 2 dB over an entire range of azimuth for each frequency between 960 MHz and 1220 MHz.

2. The antenna array of claim 1, wherein the plurality of discone antenna elements comprises 4 discone antenna elements.

3. The antenna array of claim 1, further comprising a radome covering the cavity.

4. The antenna array of claim 3, wherein the radome is curved.

5. The antenna array of claim 3, wherein a respective coaxial cable is used to supply or receive a signal from each of the discone antenna element and connectors for the coaxial cables are recessed within the cones to reduce a depth of the antenna array.

6. The antenna array of claim 4, wherein each discone antenna element has a central axis passing a center of the cone and the disc, and wherein the bottom surface is configured such that the central axis of each discone antenna element is perpendicular to the radome at the point of intersection.

7. An aircraft comprising a fuselage, a wing and the antenna array of claim 4.

8. The aircraft of claim 7, wherein the antenna array is disposed on the wing, and the radome conforms to an outer mold line of the wing.

9. The aircraft of claim 7, wherein the antenna array is disposed on the fuselage, and the radome conforms to an outer mold line of the fuselage.

10. An antenna array, comprising:

a plurality of discone antenna elements, each discone antenna element comprising a disc and a cone separated by a spacer;

a cavity having a bottom surface, wherein the plurality of discone antenna elements are all disposed in the cavity, such that the cone of each discone antenna element is in contact with the bottom surface, wherein the realized gain of the antenna array, when all of the discone antenna elements are fed, is greater than −4 dBi over an entire range of azimuth over a selected range of frequencies.

11. The antenna array of claim 10, wherein the selected range of frequencies is between 960 MHz and 1220 MHz.

12. The antenna array of claim 10, further comprising a curved radome covering the cavity.

13. The antenna array of claim 12, wherein each discone antenna element has a central axis passing a center of the cone and the disc, and wherein the bottom surface is configured such that the central axis of each discone antenna element is perpendicular to the radome at the point of intersection.

14. The aircraft comprising a fuselage, a wing and the antenna array of claim 10, wherein the antenna is disposed on the wing or on the fuselage.

15. An antenna array, comprising:

a plurality of discone antenna elements, each discone antenna element comprising a disc and a cone separated by a spacer;

a cavity having a bottom surface, wherein the plurality of discone antenna elements are all disposed in the cavity, such that the cone of each discone antenna element is in contact with the bottom surface; and a radome covering the cavity, wherein a maximum distance between the bottom surface and the radome is less than 75 mm.

16. The antenna array of claim 15, wherein the realized gain of the antenna array, when all of the discone antenna elements are fed, is within 2 dB over an entire range of azimuth for each frequency between 960 MHz and 1220 MHz.

17. The antenna array of claim 15, wherein the realized gain of the antenna array, when all of the discone antenna elements are fed, is greater than −4 dBi over an entire range of azimuth for each frequency between 960 MHz and 1220 MHz.

18. The antenna array of claim 15, wherein a respective coaxial cable is used to supply or receive a signal from each of the discone antenna element and connectors for the coaxial cables are recessed within the cones to reduce a depth of the antenna array.

19. The aircraft comprising a fuselage, a wing and the antenna array of claim 15, wherein the antenna is disposed on the wing or the fuselage.

20. An antenna array, comprising:

a plurality of discone antenna elements, each discone antenna element comprising a disc and a cone separated by a spacer;

a cavity having a bottom surface, wherein the plurality of discone antenna elements are all disposed in the cavity, such that the cone of each discone antenna element is in contact with the bottom surface; and a radome covering the cavity, wherein the cavity is filled with a material having a dielectric constant less than 1.2.

21. The antenna array of claim 20, wherein the realized gain of the antenna array, when all of the discone antenna elements are fed, is within 2 dB over an entire range of azimuth for each frequency between 960 MHz and 1220 MHz.

22. The antenna array of claim 20, wherein the realized gain of the antenna array, when all of the discone antenna elements are fed, is greater than −4 dBi over an entire range of azimuth for each frequency between 960 MHz and 1220 MHz.

23. The antenna array of claim 20, wherein a respective coaxial cable is used to supply or receive a signal from each of the discone antenna element and connectors for the coaxial cables are recessed within the cones to reduce a depth of the antenna array.

24. The aircraft comprising a fuselage, a wing and the antenna array of claim 20, wherein the antenna is disposed on the wing or the fuselage.

* * * * *